US007253741B2

(12) United States Patent
Fiorletta et al.

(10) Patent No.: US 7,253,741 B2
(45) Date of Patent: Aug. 7, 2007

(54) AUTOMATED SYSTEM TO MONITOR MULTIPLE SOURCES OF WATER LEAKS IN RESIDENTIAL AND COMMERCIAL BUILDINGS

(76) Inventors: Carl A. Fiorletta, 4600 Versailles La., Plano, TX (US) 75093; Archie Leon Woulard, 1603 Algonguin Dr., Dallas, TX (US) 75217

( * ) Notice: Subject to any disclaimer, the term of this patent is extended or adjusted under 35 U.S.C. 154(b) by 130 days.

(21) Appl. No.: 11/078,875

(22) Filed: Mar. 14, 2005

(65) Prior Publication Data

US 2006/0208912 A1 Sep. 21, 2006

(51) Int. Cl.
*G08B 21/00* (2006.01)

(52) U.S. Cl. ..... 340/605; 122/504; 137/312

(58) Field of Classification Search ..... 340/603, 340/605, 500, 524; 122/504; 137/312
See application file for complete search history.

(56) References Cited

U.S. PATENT DOCUMENTS 5,240,022 A * 8/1993 Franklin ..... 137/1
5,428,347 A * 6/1995 Barron ..... 340/604
5,632,302 A * 5/1997 Lenoir, Jr. ..... 137/312
6,025,788 A * 2/2000 Diduck ..... 340/870.16
6,084,520 A * 7/2000 Salvucci ..... 340/605
6,276,309 B1 * 8/2001 Zeek ..... 122/504
6,489,895 B1 * 12/2002 Apelman ..... 340/605
6,526,807 B1 * 3/2003 Doumit et al. ..... 73/40.5 R
7,057,507 B1 * 6/2006 Sandifer ..... 340/531

* cited by examiner

*Primary Examiner*—Brent A. Swarthout

(57) ABSTRACT

An electronic monitoring system is provided to monitor for and sense water leakage at multiple locations and sources within a commercial or residential property. These sources are hot water heaters, hot water boilers, air conditioning system evaporators, washing machines and sinks. The microprocessor based control will determine the location of the leak, sound a local audio and visual alarm to denote an alarm condition and illuminate appropriate LED's on the face of the control to indicate the location and type of water leak within the structure being monitored. The system consists of multiple water sensors, a host control for data collection and system operation, an internal battery for system power, provision for connection to telephone service, with the ability to call a pre-programmed pager or telephone number to deliver synthesized voice or prerecorded voice data to indicate the address of the property, the day, date and time of the alarm and the type of leak detected.

2 Claims, 5 Drawing Sheets

AUTOMATED SYSTEM TO MONITOR MULTIPLE SOURCES OF WATER LEAKS IN RESIDENTIAL AND COMMERCIAL BUILDINGS

BACKGROUND OF THE INVENTION

Home owners like most owners of commercial property, outsource routine maintenance to professional plumbers. Typically, commercial plumbers have contracts to concurrently provide maintenance services on multiple properties. These properties might include large numbers of rental properties in the form of single family homes, apartment buildings, office buildings and retail stores. The objective of this invention is to provide a means to automatically monitor these structures and have the same monitoring system contact the plumber via cell phone to report the type of service that is required, and the location of the property in question. Single family homes, apartments, office buildings, schools and retail stores have multiple sources of water leaks that may be potentially damaging to the structure and the interior contents. These sources of damaging water leaks are hot water heaters, hot water boilers used for building heat, air conditioning systems that collect water within the evaporator housing, dishwashers, clothes washing machines, kitchen and bathroom sinks. In each case, water that is spilled, water that leaks from a water heater or air conditioning system or water that is collected in an undesirable location is a potential source for structural damage. In the case of a simple water heater or a commercial boiler that is used for building heat, there are two sources of a water leak. Water heaters typically have two means of failure that would discharge water. These are a perforated water heater storage tank, due to rust, or water being discharged from the over temperature and pressure valve (TNP) located in the top or the side of a water heater. It is not uncommon for a TNP valve to leak or fail in the open position, thereby discharging water onto the floor or into the overflow tank located under the water heater. In some cities, building codes require that the TNP valve be plumbed into the sewer. In this situation, an unmonitored TNP discharge system could continuously flow city water into the sewer, without anyone's knowledge. Over a period of time, this could be costly to the property owner.

In a residence, apartment or retail space, the water heater may be located in the basement, in the garage, in a closet or enclosure adjacent to the living area on the first, second or third floor. In a residence, office building or retail space, when the water heater is installed above a living area or office area, a water leak from the storage tank could cause extensive damage to flooring, carpet, furnishings or the structure itself. A hot water discharge from the TNP valve could be equally damaging to the structure and the interior of the building, depending on how the TNP valve is installed. The TNP valve may simply discharge to the water closet or into a pan under the water heater. More recent city building codes require the TNP valve to be plumbed into a closed drain that carries the hot water from the TNP valve into the buildings connection to the city sewer. If the TNP valve is properly plumbed to a closed drain and fails in the open position, as they typically do, it is unlikely that the property owner would know that city water is flowing through the water heater into the sewer. This leaking TNP valve will cause cold city water to continuously flow into the water heater, lowering the temperature of the water and thereby causing the water heater to heat water continuously, which drives up two utility costs, the gas or electricity use to heat the water and, of course, the cost of the water that is flowing into the drain.

The present invention consists of three major components. These are a) multiple water sensors that may be used under the water heater to detect leaks in the storage tank or water connections to the water heater, used under a sink, washing machine or air conditioning unit to monitor for water that is collecting due to a leak, b) a second type of water detector that is installed in the discharge line from the TNP valve and c) a single microprocessor based controller that collects data from the various sensors distributed throughout the structure and deliver an alarm to the property owner or a plumber who is providing maintenance to that property.

While this invention is designed to monitor multiple sources of water leaks in a building, there are several U.S. patents for sensing systems that focus on water heaters to detect leaks and turn off the water and heating source energy to the water heater. These patents include Franklin U.S. Pat. No. 5,240,022 and Barron U.S. Pat. No. 5,428,347, which disclose sensor systems, used in conjunction with hot water tanks designed to shut off the water supply in response to the detection of water leaks. There is now evidence that shows that shutting off the water supply to the water heater may cause severe overheating of the water heater, which thereby causes a water heater explosion. The objective of the invention described herein is to provide an early warning of a leak and the means to immediately notify a plumber to provide the repairs necessary. Furthermore, a slow leak is not, in our opinion, sufficient reason to shut off power and water to the water heater, which would render the household or structure without hot water, which would be very inconvenient to the residents or occupants. Early detection of a leak may permit the water heater, for example, to stay in service until repairs are made.

Three other United States patents, to Lenoir U.S. Pat. No. 5,632,302, Salvucci U.S. Pat. No. 6,084,520, and Zeke U.S. Pat. No. 6,276,309 all disclose safety systems for use in conjunction with a hot water tank. The systems of these patents all include sensors which operate in response to leaked water to close the water supply valve to the hot water tank. The systems disclosed in the Salvucci and Zeke patents also employ the sensing of leaked water to shut off either the gas supply or the electrical supply to the hot water tank, thereby removing the heat source as well as the supply water to the hot water tank.

While the various systems disclosed in the prior art patents discussed above function to sense potential malfunctioning of a hot water tank to either turn off the water supply, the energy supply, or both, to prevent further damage, none of the systems disclosed in these patents are directed to the monitoring of the entire structure for water leaks from multiple devices and sources, as previously mentioned, or the means to identify the type of leak or failure and contacting service personnel with a timely report of the type of failure, the day/date and time of the failure as well as the address of the property.

BRIEF SUMMARY OF THE INVENTION

The present invention is a solid state control system that may be used to monitor any source for water leaks. These sources may be hot water heaters, air conditioning system evaporator housings, clothes washing machines, water fil tration and water softening systems. The objective of this invention is to provide, to the property owner, early detection of a water leak from any of these sources and provide notification of such failures to service personnel in a timely fashion.

The components of the control system include the host micro-processor in a single enclosure, a multitude of water sensors that may be placed under any source of a water leak, such as a water heater, sink or clothes washing machine, be placed in a housing or container to monitor for a water level, such as a drain pan under a water heater or a housing around an air conditioning evaporator and finally, a water sensor that is installed downstream of the over temperature and pressure valve (TNP) to indicate a leaking or open TNP valve.

Contained within the microprocessor housing is the control electronics, a means to connect the housing to a telephone line, a visual alarm via illuminated LED's, an audio alarm as well as a flag that is exposed when the audio alarm is sounded. The flag is an important feature in systems that are powered by disposable batteries. If the property owner is not present when the audio alarm is given, and returns after the audio alarm completely discharges the on-board batteries, the extended flag provides lasting evidence that an alarm condition has occurred. In a preferred embodiment of this invention, the control is powered by AC power from the dwelling or structure and is connected to the dwellings telephone line so that it may call a service contractor or plumber to report the address of the property that requires attention. The visual flag/alarm also confirms to the repair personnel that the cell phone alert provided to them the correct address for the alarm system and failure.

DETAILED DESCRIPTION OF THE INVENTION

Figure 1:
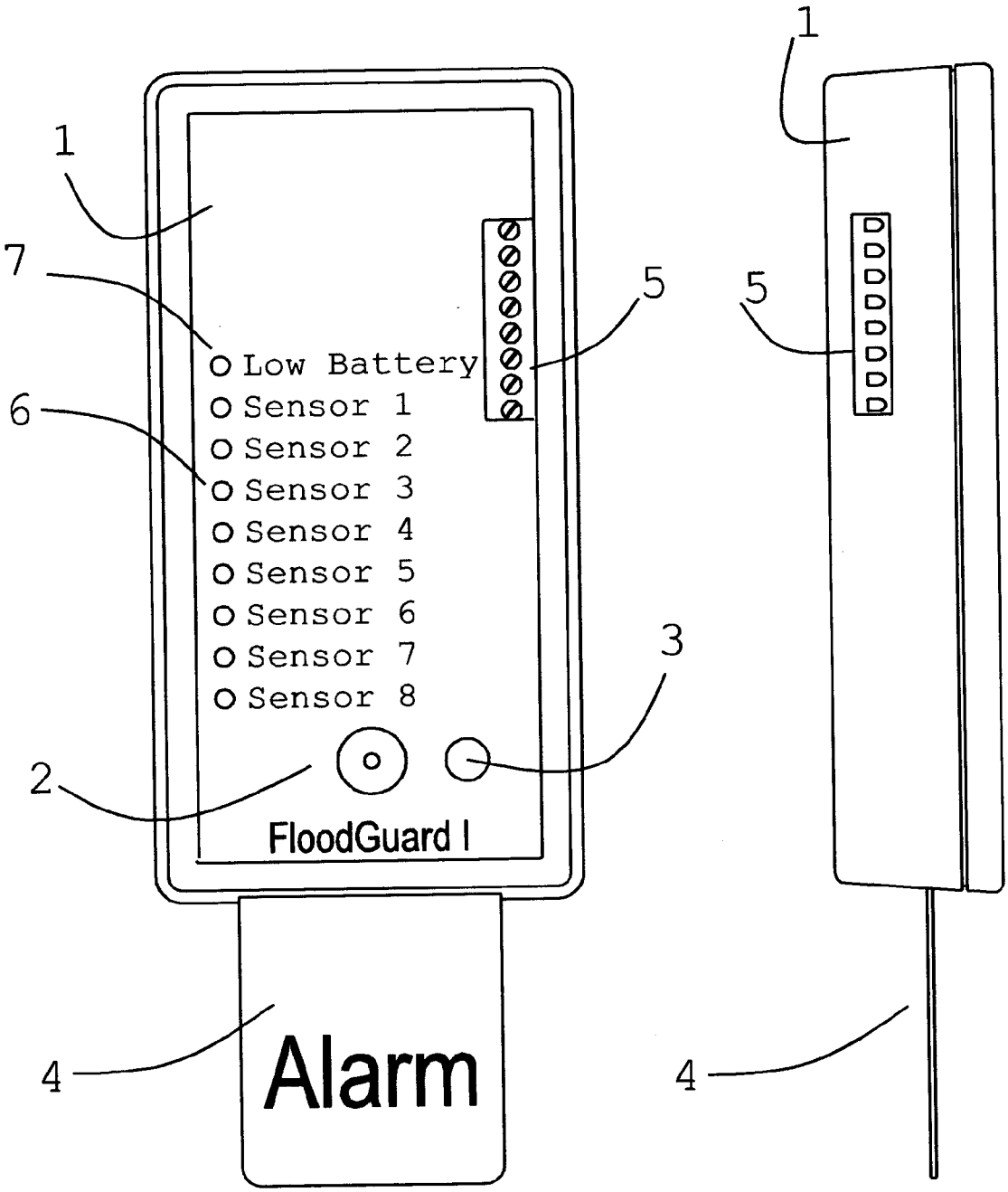
FIG. 1: Front and side view of the invention showing the extended-physical alarm, screw terminals for wire connection to water sensors and LED's that illuminate on LOW BATTERY condition and water sensed at any location throughout the structure.

The preferred embodiment of the present invention consists of (FIG. 1) an integrated single control module 1, an audio alarm 2 to indicate that there is an alarm condition, a push-to-silence button 3 for the property owner to silence the alarm, an alarm flag 4, that drops down from within the enclosure to indicate that an alarm condition exists. Alarm conditions are water under the water heater, water in the TNP discharge line, high water levels in one or more air conditioning system evaporators, water collected at any sensor location and a low battery. Connection terminals 5 provide a means for the enclosure to be connected to external water sensors. When an alarm condition exists, the alarm flag 4 drops from its retracted position within the enclosure 1 and at least one LED is illuminated to indicate the type of alarm given. Separate LED's are provided to indicate the presence of water at any sensor location 6. An additional LED will illuminate to provide a low battery warning 7 until the battery is completely discharged. Since the physical alarm flag has already been dropped to indicate an alarm, a completely discharged battery is not of grave consequence. If the invention is installed in a conspicuous location, as we would recommend, the extended, brightly colored alarm flag will be easily noticed by the property owner or resident.

Figure 2:
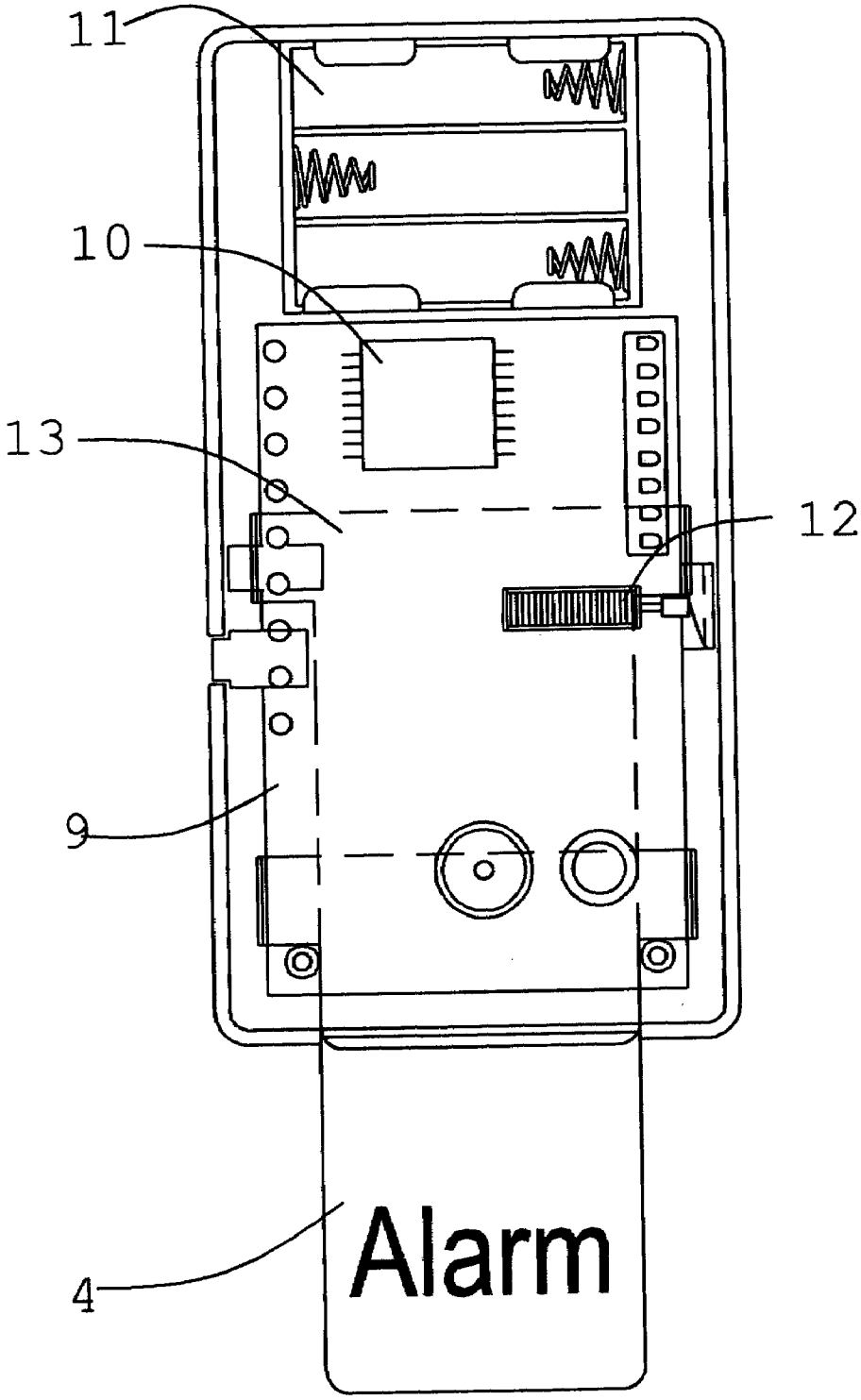
FIG. 2: Front view of the FIG. 1 control housing with the cover removed to show the location of the battery holder and the solenoid that releases the physical ALARM flag, the audio alarm and a push-to-silence button to stop the audio alarm.

Shown with the cover removed (FIG. 2), several of the internal system components are shown. These are the printed circuit board 9 with micro processor-voice memory chip set 10 and associated circuitry, the battery pack 11, the aforementioned alarm flag 4 shown in the extended position, a solenoid and plunger assembly 12 that is used to retain the flag in a retraced position 13 when no alarm condition exists.

Figure 3:
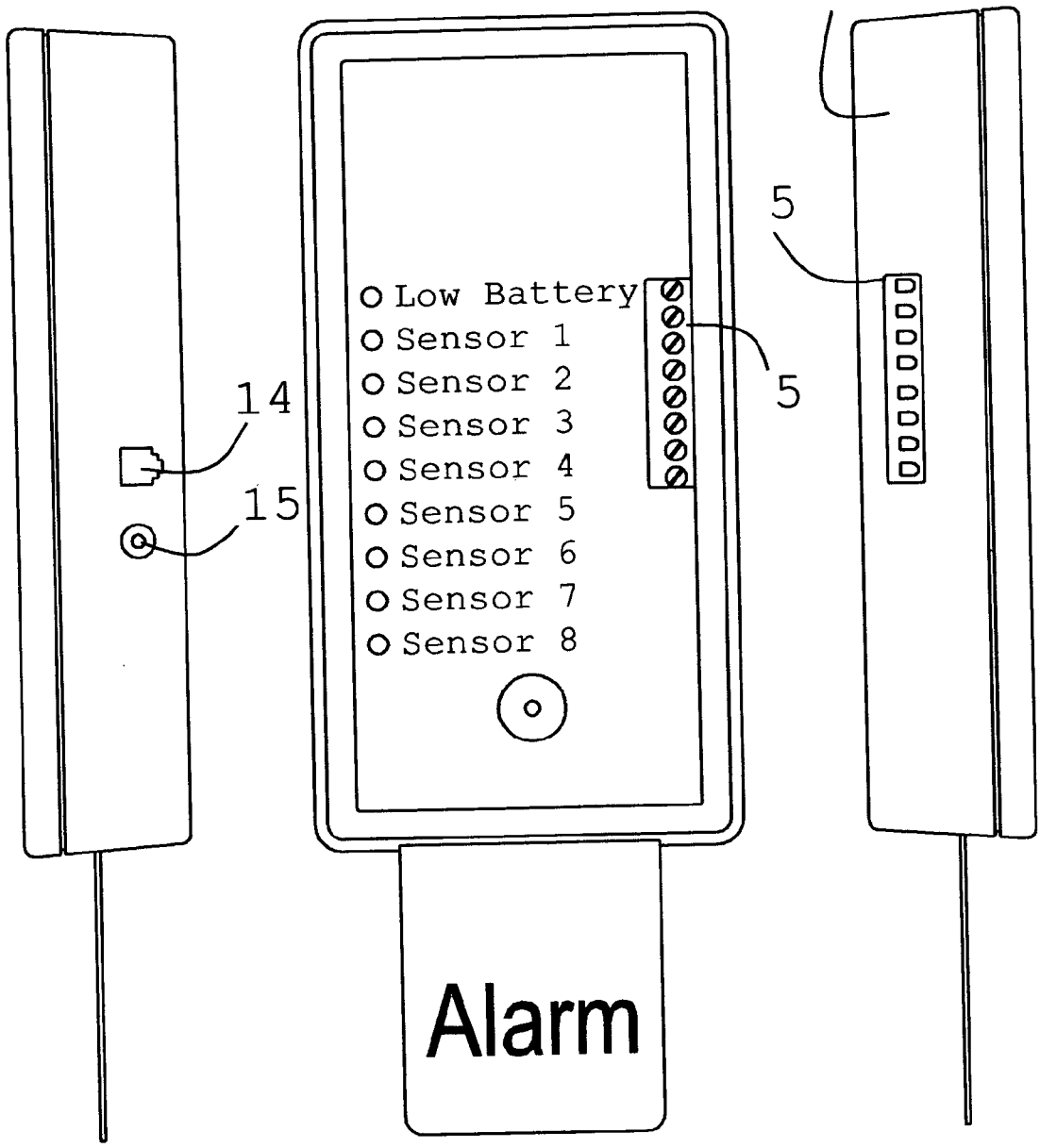
FIG. 3: Front and two side views of the invention. Shows a fully optioned version of the invention with a sufficient number of sensor inputs to monitor multiple water heaters, air conditioning evaporators and other sources of water leaks. A telephone jack is provided so that the invention may call or page a serviceman to report the physical address of the property that requires service.

Shown in the fully optioned version of the present invention (FIG. 3), connections 5 are provided for a number of water sensors located throughout the structure. A telephone jack 14 is provided for connection to a telephone line that services the property, connector 15 is provided for connection of the system to AC power in the dwelling. With AC power connected, the internal battery becomes a backup to the house power. Using the telephone line, the present invention will call a pre-programmed telephone or pager number to report the time of the alarm condition and the address of the property that is now sounding a local alarm.

Figure 4:
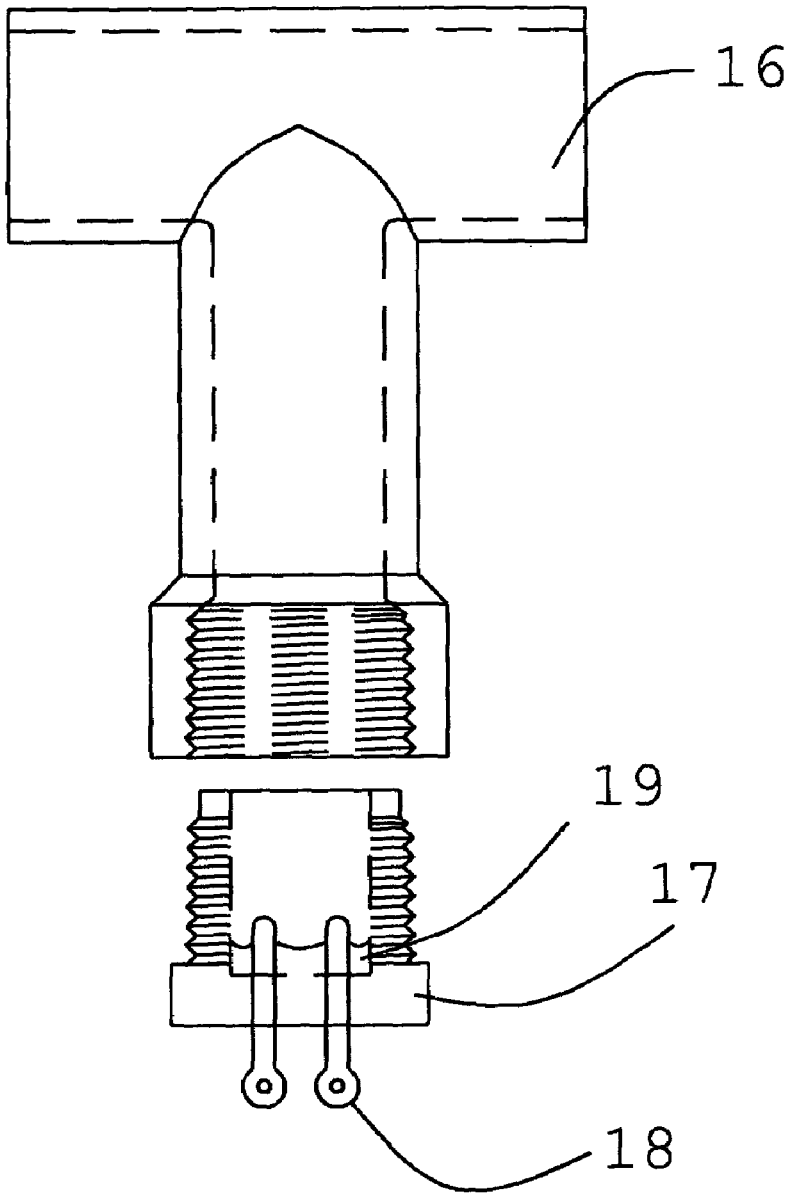
FIG. 4: Describes a water sensor that is used to detect water in the TNP discharge line.

The TNP water sensor (FIG. 4) is used to detect water in the discharge line downstream of the TNP (temperature and pressure) valve. The sensor housing 16 is inserted in a horizontal drain pipe from the TNP valve. The sensor 17, which easily screws into the sensor housing 16, provides two electrodes 18 that are connected to the terminals 5 of the control housing. When a small amount of water 19 is captured in the electrode housing 16, the water 19 bridges the two electrodes 18 and changes the resistance between the two electrodes. The CPU in the control housing senses this change in resistance between the electrodes, sounds the audio alarm, drops the alarm flag and calls a pre-recorded telephone number to report the type and location of the alarm.

Figure 5:
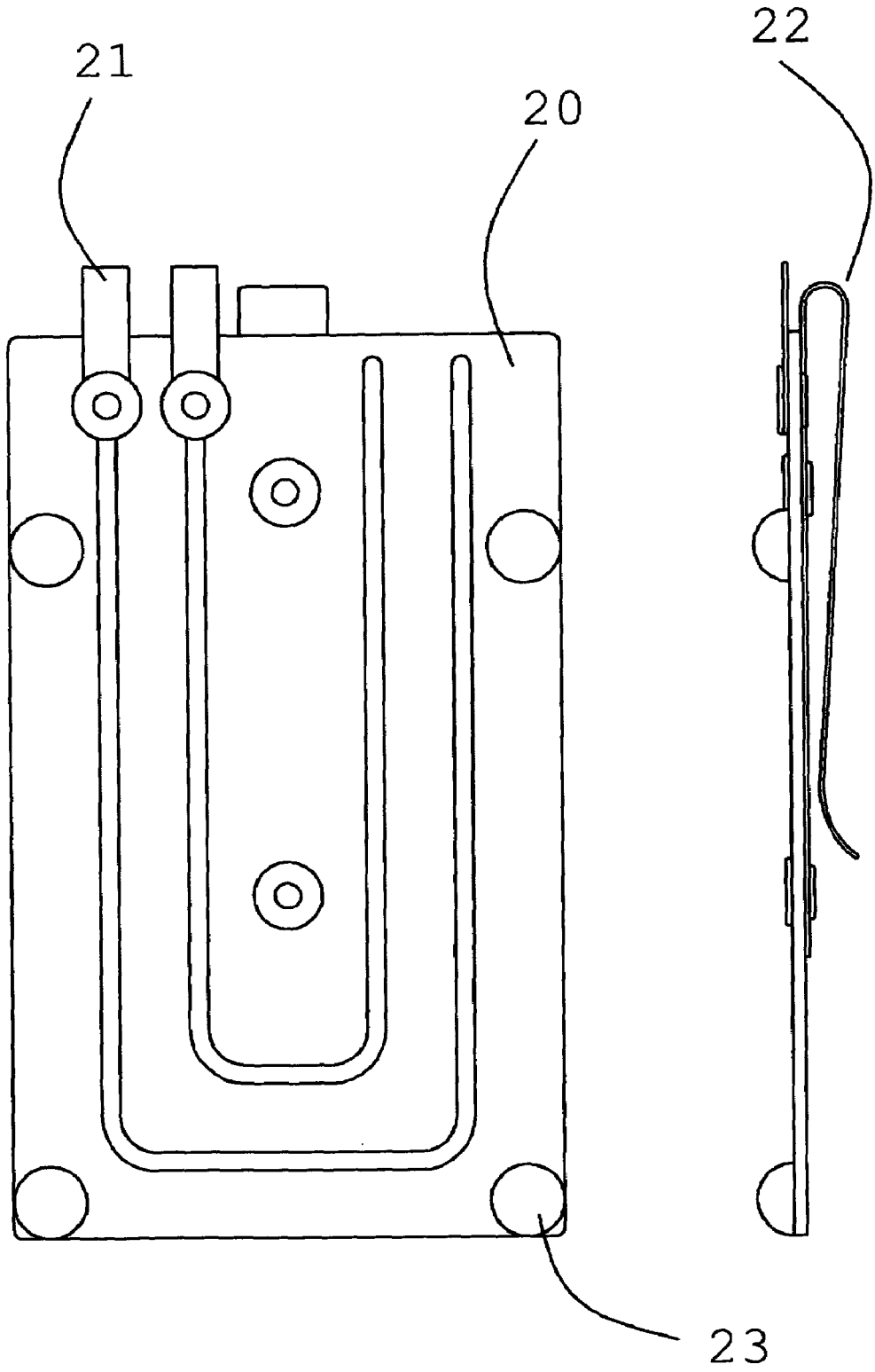
FIG. 5: Front and side view of a water sensor that is used to detect water in a drain pan located under a water heater or the water/condensation collection pan contained within or under an air conditioning system evaporator.

An additional water sensor 20 (FIG. 5) is used to detect water in a catch pan under a water heater or an air conditioning system evaporator. This sensor, typically 3"×5" provides two conductive circuits with terminals 21 for two (2) slip-on connectors. When water bridges the two circuits, the resistance changes, the control recognizes the change, and sounds the alarm. Located on the back side of the sensor 20, is a spring clip 22 for easy attachment to the side of a drain pan. For installers who choose to lay the sensor flat or horizontal in the bottom of the drain pan or on the floor under a water heater, sink, washing machine or any other source of water, rubber bumpers 23 are provided.

THe invention claimed is:

1. A whole house monitoring system for early detection of water leakage from a number of water sources located within a residential or commercial building, which comprises:

water detection sensors located in the discharge line of TNP (over temperature and pressure) valves on one or more water heaters;

water detection sensors located under one or more water heaters;

water detection sensors located in drain pans under the water heaters;

water detection sensors located in one or more air conditioning system evaporator housings located within the property to sense high water levels in the housing;

water detection sensors located under clothes washing machines and sinks;

a microprocessor based control module with electrical communication to a plurality of sensors located throughout the structure, the control module in communication with a plurality of water detection sensors will respond to an output signal from a sensor and emit multiple alarms that consists essentially of:

an audio alarm that locally reports the existence of an alarm condition in the property;

an illuminated LED on the face of the control module to indicate the location of the water detected;

and a physical flag moved to an exposed position external to the housing to indicate the existence of an alarm condition.

2. The monitoring system control according to claim 1 further includes:

an internal electric data access arrangement (DAA) for direct communication to other telephones and pagers;

a microprocessor and voice synthesis chip-set to deliver an audio voice message to pre-recorded telephone and cell phone numbers;

the ability to dial a prerecorded telephone number to report the day, date, time, physical address and type of the water leak detected;

* * * * *